US007975862B2

(12) United States Patent
Gnepper

(10) Patent No.: US 7,975,862 B2
(45) Date of Patent: Jul. 12, 2011

(54) CHILD-RESISTANT DISPENSING PACKAGE

(75) Inventor: Maurice R. Gnepper, Fremont, OH (US)

(73) Assignee: Rexam Healthcare Packaging Inc., Perrysburg, OH (US)

( * ) Notice: Subject to any disclaimer, the term of this patent is extended or adjusted under 35 U.S.C. 154(b) by 1064 days.

(21) Appl. No.: 11/784,083

(22) Filed: Apr. 5, 2007

(65) Prior Publication Data

US 2008/0245796 A1 Oct. 9, 2008

(51) Int. Cl.

| | |
|---|---|
| ***B65D 43/14*** | (2006.01) |
| ***B65D 85/00*** | (2006.01) |
| ***G09F 9/00*** | (2006.01) |
| *G07F 11/00* | (2006.01) |

(52) U.S. Cl. ..... 215/224; 215/230; 206/459.5; 206/534; 116/308; 116/309; 116/311; 40/311

(58) Field of Classification Search ..... 220/281, 220/253, 916; 40/311; 215/230, 201, 216–221; 206/459.1, 508, 534; 222/480, 153.09, 153.1, 222/153.04, 153.14; 116/308, 311, 315, 116/309; 221/4

See application file for complete search history.

(56) References Cited

U.S. PATENT DOCUMENTS

| | | | | |
|---|---|---|---|---|
| 2,408,150 | A | 9/1946 | Moeller | |
| 3,020,659 | A * | 2/1962 | Paulini | 40/307 |
| 3,241,712 | A | 3/1966 | Sacchetti et al. | |
| 3,638,830 | A | 2/1972 | Belokin, Jr. | |
| 3,871,551 | A | 3/1975 | Bender | |
| 3,911,856 | A | 10/1975 | Ewing | |
| 4,011,829 | A | 3/1977 | Wachsmann et al. | |
| 4,376,497 | A | 3/1983 | Mumford | |
| 4,548,331 | A | 10/1985 | Montgomery | |
| 4,613,063 | A | 9/1986 | Wright | |
| 4,749,093 | A * | 6/1988 | Trick | 215/220 |
| 5,449,085 | A | 9/1995 | Brun, Jr. | |
| 5,971,154 | A | 10/1999 | Toren | |
| 6,068,126 | A | 5/2000 | DeJonge | |
| 2005/0205458 | A1 | 9/2005 | Pearson | |
| 2005/0205598 | A1 | 9/2005 | Gelardi | |

FOREIGN PATENT DOCUMENTS

| | | |
|---|---|---|
| GB | 998148 | 7/1965 |
| GB | 2116153 A | 9/1983 |

* cited by examiner

*Primary Examiner* — Robin A. Hylton
(74) *Attorney, Agent, or Firm* — Reising Ethington PC

(57) ABSTRACT

A child-resistant package includes a housing having an internal volume for holding items to be dispensed, a cylindrical neck, an end wall on the neck and a dispensing opening in the end wall. A closure has an end wall with a dispensing opening and a skirt. One of the skirt and the neck, preferably the neck, has a channel and the other of the skirt and the neck, preferably the skirt, has a bead for receipt in the channel such that the closure is rotatable on the neck for selectively aligning the dispensing openings to dispense items from within the housing. A child resistance mechanism between the closure and the neck resists rotation of the closure on the neck. The end wall of the closure preferably includes a dosage window, and a disk preferably is disposed between the closure and the end wall of the neck having dosage indicia viewable through the dosage window. A ratchet drive preferably is disposed among the closure, the housing and the disk for indexing the disk upon each rotation of the closure on the neck to align the dispensing openings, but to resist rotation of the disk upon rotation of the closure in the opposite direction.

28 Claims, 9 Drawing Sheets

CHILD-RESISTANT DISPENSING PACKAGE

The present disclosure relates to a package for dispensing products such as prescription medication, and more particularly to a child-resistant package that encourages compliance with a prescription regimen by indicating dosage times on the package.

BACKGROUND AND SUMMARY OF THE DISCLOSURE

The present disclosure embodies a number of aspects that can be implemented separately from or in combination with each other.

A child-resistant package in accordance with an exemplary embodiment of the present disclosure includes a housing having an internal volume for holding items to be dispensed, a cylindrical neck, an end wall on the neck and a dispensing opening in the end wall. A closure has an end wall with a dispensing opening and a skirt. One of the skirt and the neck, preferably the neck, has a channel and the other of the skirt and the neck, preferably the skirt, has a bead for receipt in the channel such that the closure is rotatable on the neck for selectively aligning the dispensing openings to dispense items from within the housing. A child resistance mechanism between the closure and the neck resists rotation of the closure on the neck. The end wall of the closure preferably includes a dosage window, and a disk preferably is disposed between the closure and the end wall of the neck having dosage indicia viewable through the dosage window. A ratchet drive preferably is disposed among the closure, the housing and the disk for indexing the disk upon each rotation of the closure on the neck to align the dispensing openings, but to resist rotation of the disk upon rotation of the closure in the opposite direction.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
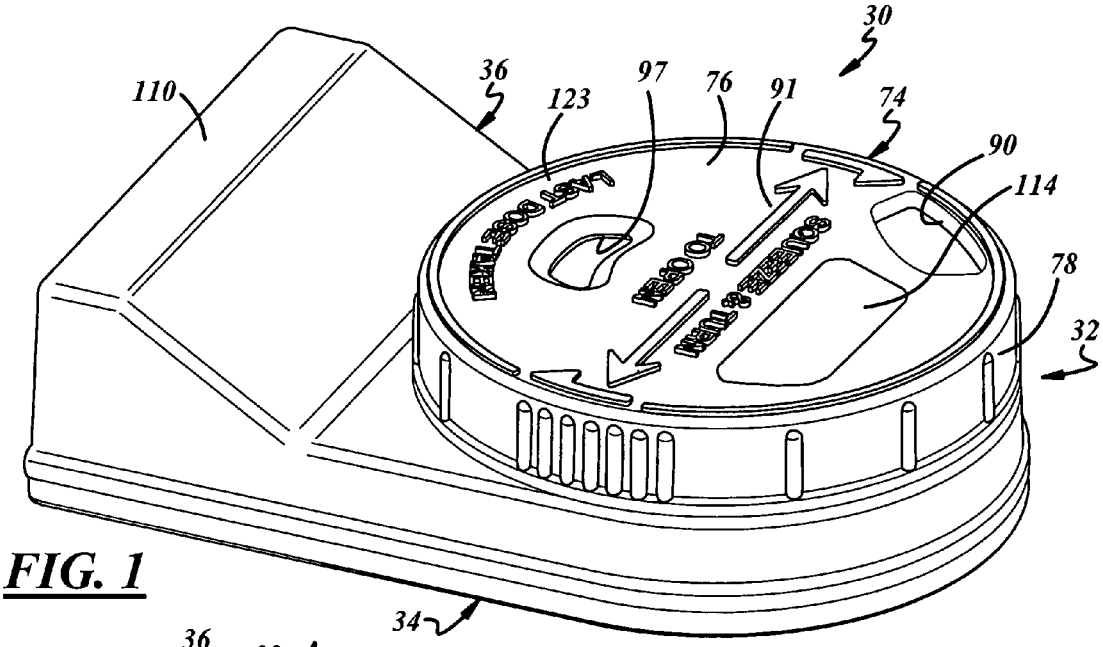
FIG. 1 is a perspective view of a package in accordance with an exemplary embodiment of the present disclosure.
Figure 2:
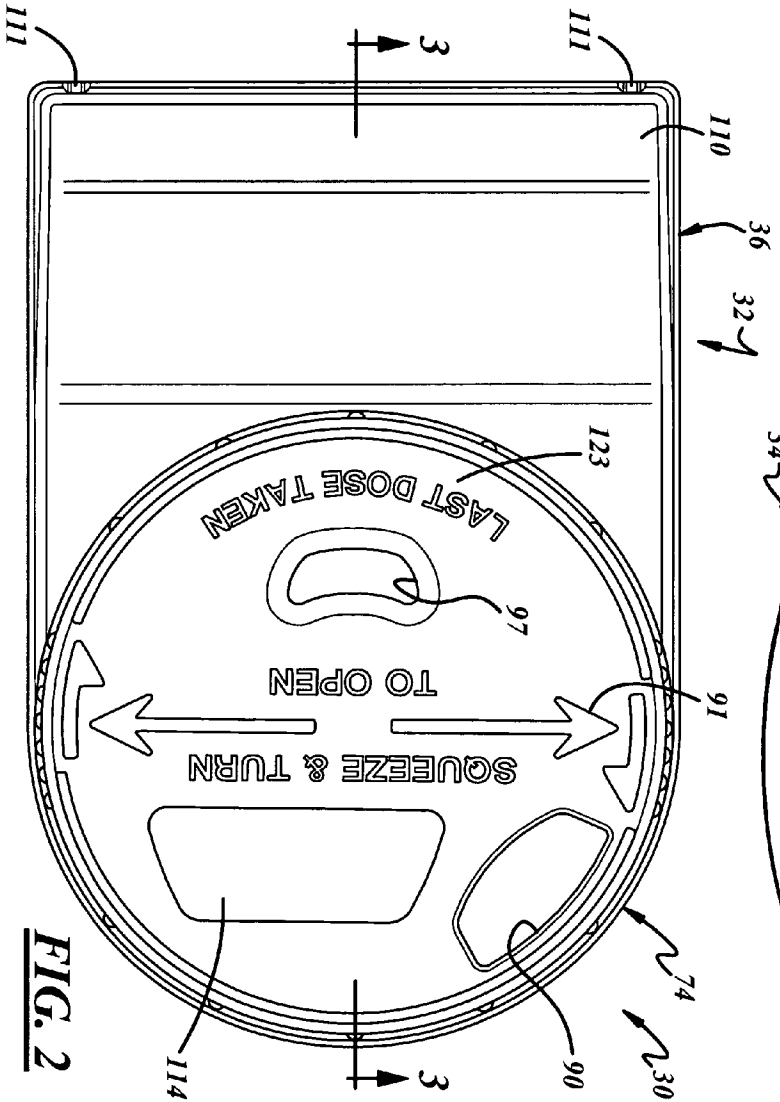
FIG. 2 is a top plan view of the package in FIG. 1.
Figure 3:
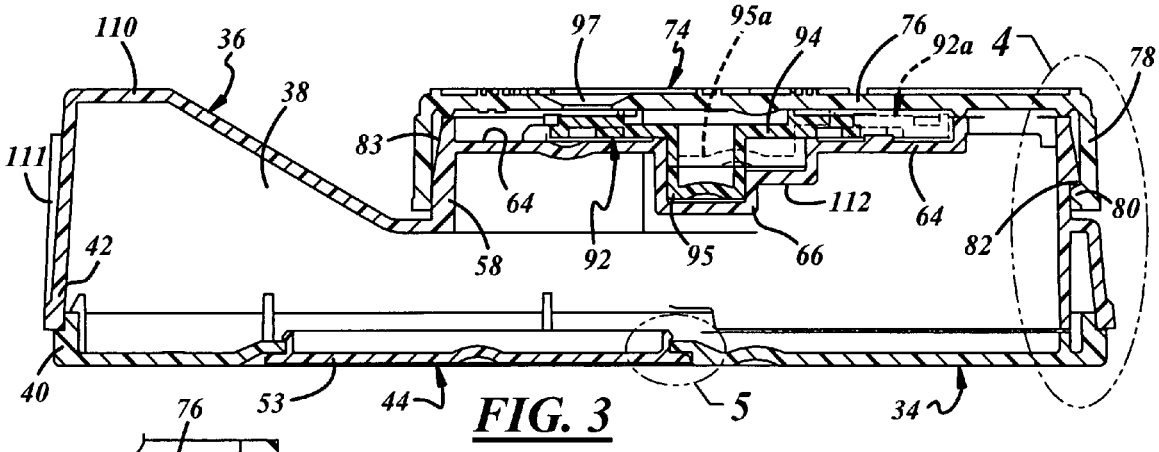
FIG. 3 is a sectional view taken substantially along the line 3-3 in FIG. 2.
Figure 4:
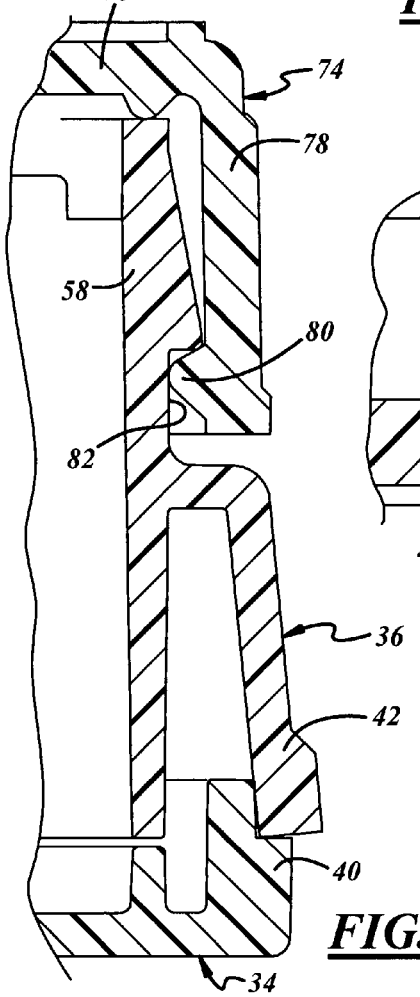
FIGS. 4 and 5 are fragmentary sectional views on enlarged scales of the portions of FIG. 3 within the respective areas 4 and 5.
Figure 5:
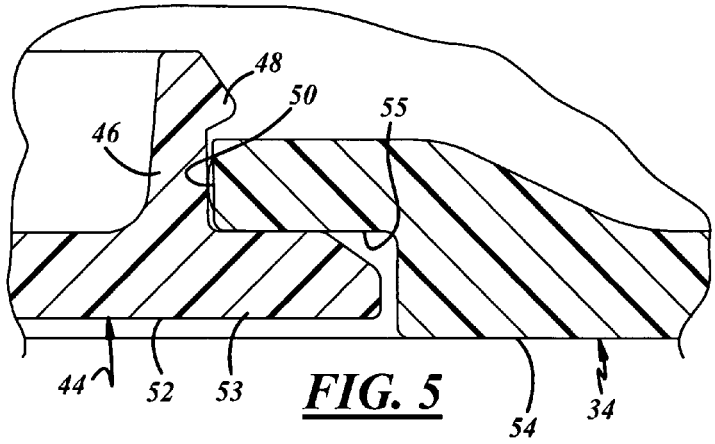
Figure 6:
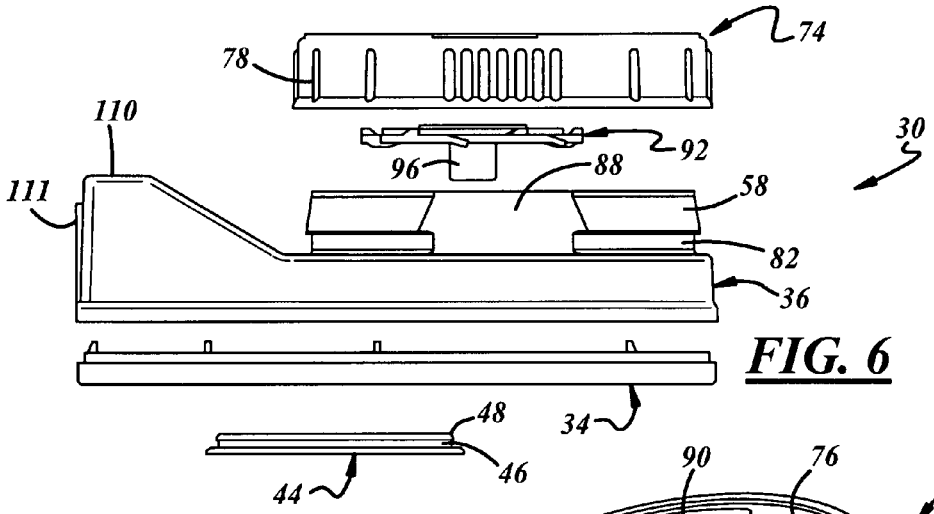
FIG. 6 is an exploded elevational view of the package illustrated in FIGS. 1-5.
Figure 7:
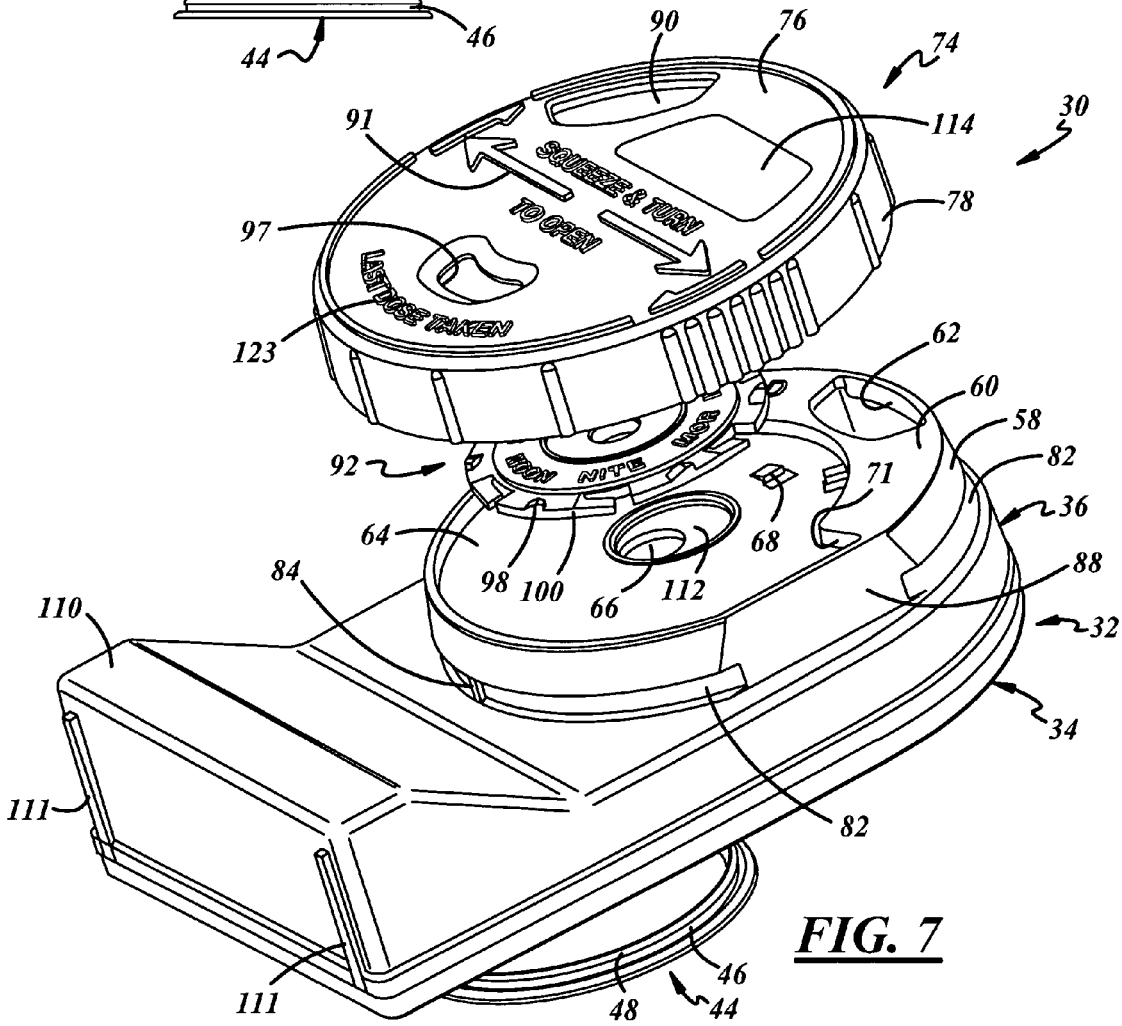
FIG. 7 is a top exploded perspective view of the package in FIGS. 1-6.
Figure 8:
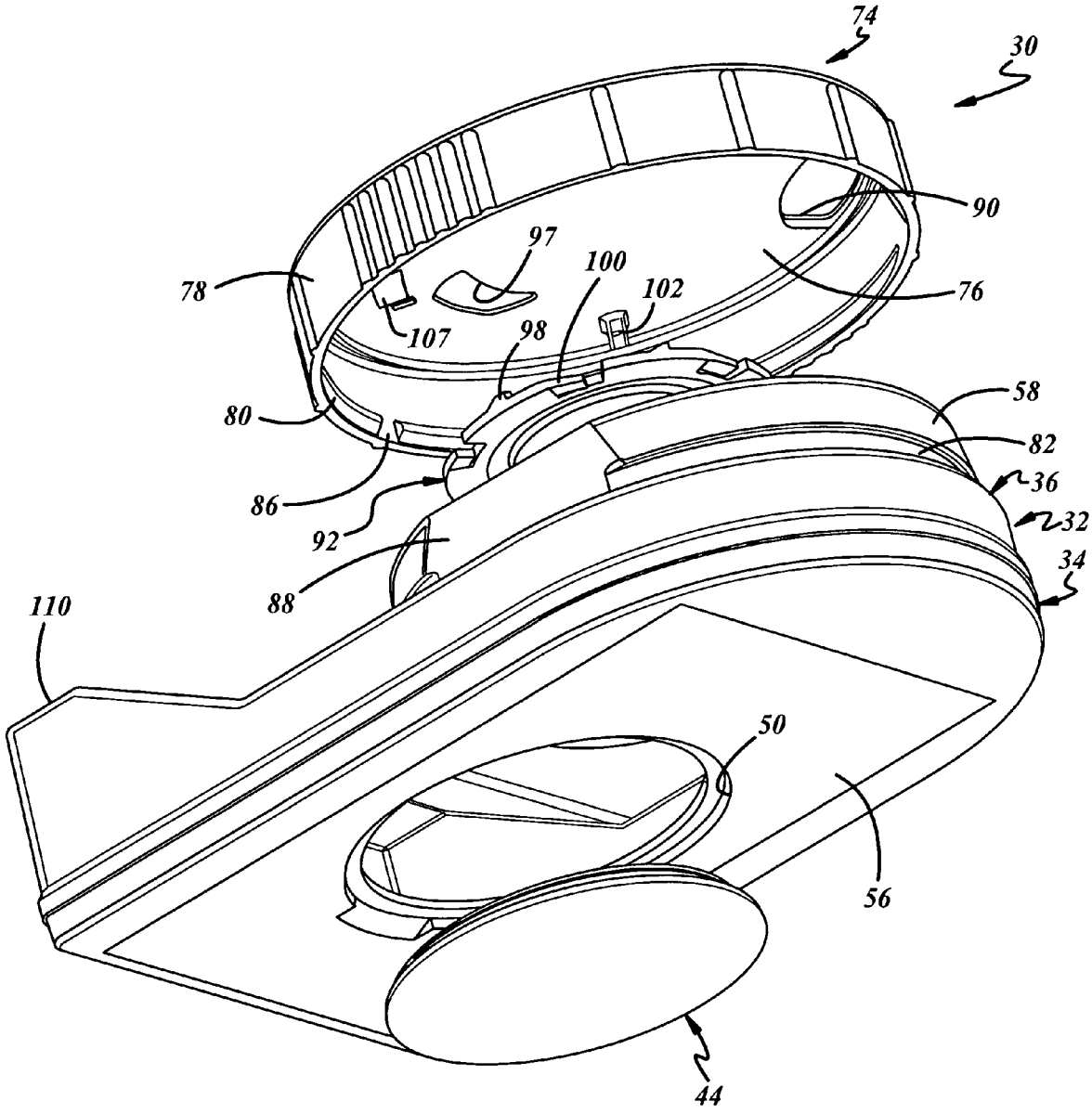
FIG. 8 is a bottom exploded perspective view of the package in FIGS. 1-7.
Figure 14:
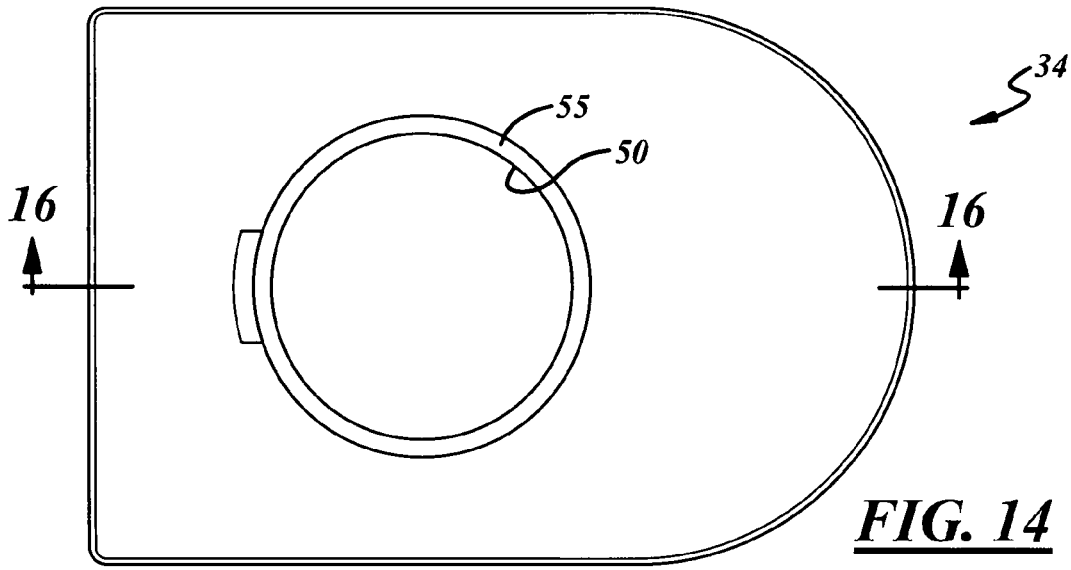
FIG. 14 is a bottom or outside plan view of the housing bottom plate in the package of FIGS. 1-8.
Figure 15:
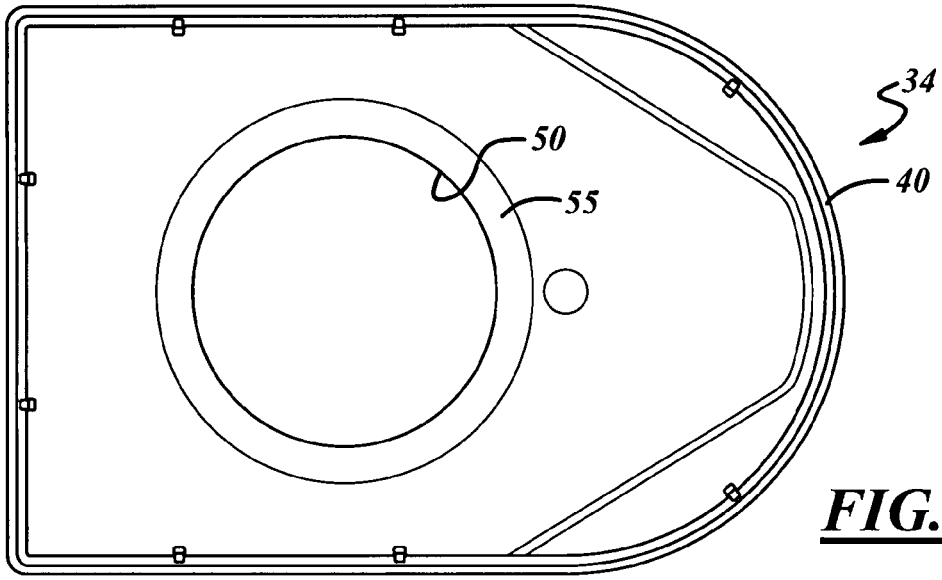
FIG. 15 is a top or inside plan view of the housing bottom plate in FIG. 14.
Figure 16:
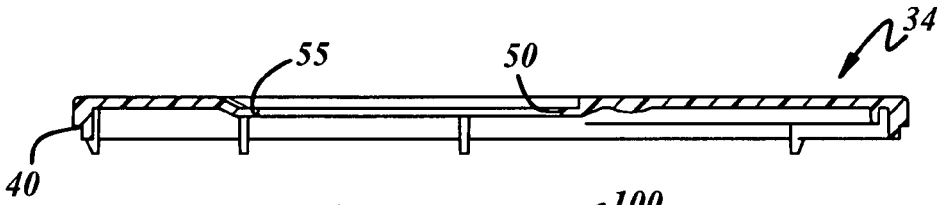
FIG. 16 is a sectional view taken substantially along the line 16-16 in FIG. 14.

FIGS. 1-8 illustrate a package 30 in accordance with an exemplary embodiment of the present disclosure. Package 30 includes a housing 32 that preferably is composed of a bottom plate 34 welded or otherwise secured around the periphery of a top panel 36. Housing 32 has an interior volume 38 (FIG. 3) for holding items, such as medicinal products, to be dispensed. Bottom plate 34 is generally flat, having a peripheral lip 40 opposed to and coupled to a peripheral lip 42 on housing top panel 36. A cap 44 has an annular wall 46 with an external bead 48 for snap receipt within an opening 50 in bottom plate 34 (FIGS. 3 and 5). There preferably is an interference seal between annular wall 46 and opening 50. The outer surface 52 of cap 44 preferably is substantially flush with the outer surface 54 of housing bottom plate 34 to provide a substantially flat label application area 56 (FIG. 8) over cap 44. Cap top panel 53 preferably is seated against a recessed shoulder 55 on bottom plate 34 (FIGS. 3 and 5). Cap 44, opening 50 and recess 55 preferably are circular (FIGS. 8 and 14). Application of a label, such as a prescription label, in label area 56 over cap 44 provides tamper indication in that cap 44 cannot be removed without tearing or destroying the label.

Housing top panel 36 includes a cylindrical neck 58 that extends away from bottom plate 34. Cylindrical neck 58 terminates in an end wall 60 (FIGS. 7 and 9) in which a dispensing opening 62 is disposed. A recessed shoulder 64 is formed in end wall 60 for purposes to be described. A pocket 66 (FIGS. 3 and 9) is formed in recessed shoulder 64. A disk stop 68 is provided in recessed shoulder 64 at a position spaced from pocket 66. Disk stop 68 has a counterclockwise facing cam surface 70 (with respect to the axis of pocket 66) and a clockwise-facing abutment face 72 for purposes to be described. In the embodiment illustrated in FIGS. 7, 9 and 12-13, there are a pair of disk stops 68 at differing radii from the axis of pocket 66, each with associated cam surfaces 70 and abutment faces 72. There are a pair of angularly spaced oppositely facing stops 71, 73 (FIGS. 7 and 9) on end wall 60 within shoulder 64.

A closure 74 is received by snap fit over neck 58. Closure 74 is generally cup-shaped, including a generally flat end wall 76 and a flexible resilient annular peripheral skirt 78. Skirt 78 has an internal bead 80, which can be continuous or segmented, received by snap fit within an external channel 82 on neck 58. Neck 58 preferably has a sloping surface 83 to facilitate assembly of closure 74 onto neck 58, and closure 74 preferably is non-removable from neck 58 without substantial destruction of the closure and/or the neck. A rib 84 (FIG. 7) extends across channel 82, preferably diametrically opposite dispensing opening 62 in end wall 60 as best seen in FIG. 7. Internal bead 80 on closure skirt 78 has a slot 86 (FIGS. 8 and 21) for receipt by snap fit over rib 84 to prevent rotation of closure 74 on neck 58 absent ovalization of skirt 78. Such ovalization preferably is achieved by squeezing skirt 78 on diametrically opposed sides. Diametrically opposed flats 88 are provided on neck 58 to permit inward flexure of skirt 78, which ovalizes skirt 78 along an axis at 90° to the direction of squeezing, which moves slot 86 radially outwardly from rib 84 and permits rotation of the closure on the neck. Closure 74 has a dispensing opening 90 in closure end wall 76 for selective alignment with dispensing opening 62 in neck end wall 60 to dispense product from within housing 32. Indicia 91 preferably are provided on end wall 76 to instruct a user how to align the dispensing openings. After dispensing product from within the package, closure 74 can be rotated to its original position, at which point slot 86 (FIG. 8) snaps over rib 84 (FIG. 7) and dispensing opening 90 registers with CLOSED indicia 93 (FIG. 9) on end wall 60. In this closed position, a V-seal 103 (FIG. 21) on the undersurface of closure wall 76 surrounds and helps seal dispensing opening 62. The limits of closure rotation are defined by abutment of a stop lug 101 on the undersurface of closure wall 76 (FIG. 21) with stop 73 on neck end wall 60 (FIG. 9) in the fully open position, and by abutment of a closure stop 102 with end wall stop 71 in the fully closed position.

Figure 17:
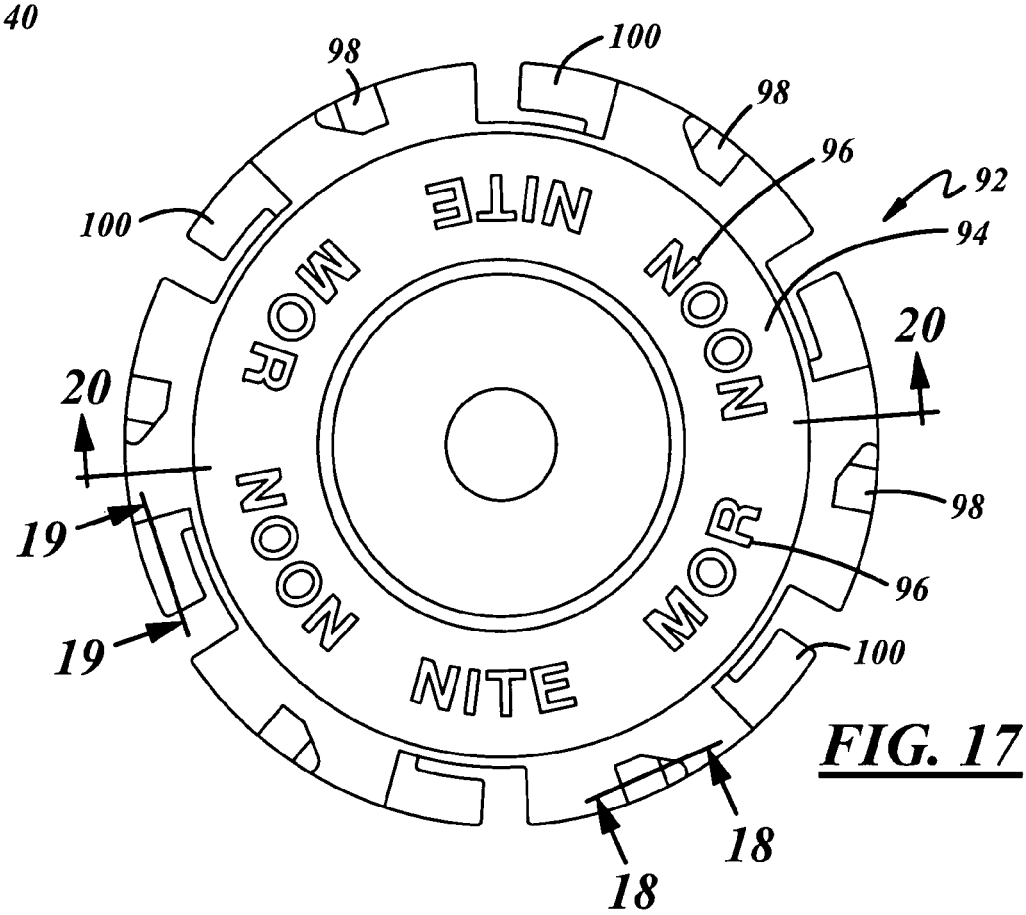
FIG. 17 is a top plan view of the indexing disk in the package of FIGS. 1-8.
Figure 18:
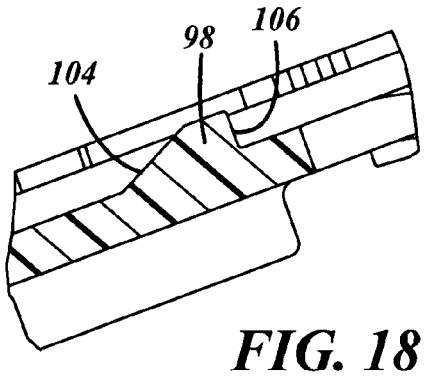
FIGS. 18, 19 and 20 are sectional views taken substantially along the respective lines 18-18, 19-19 and 20-20 in FIG. 17.
Figure 19:
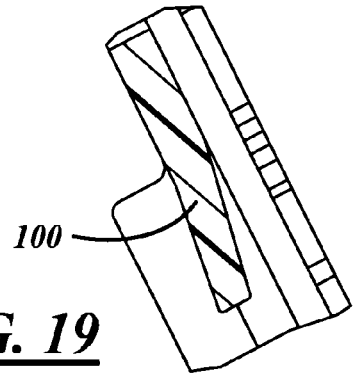
Figure 20:
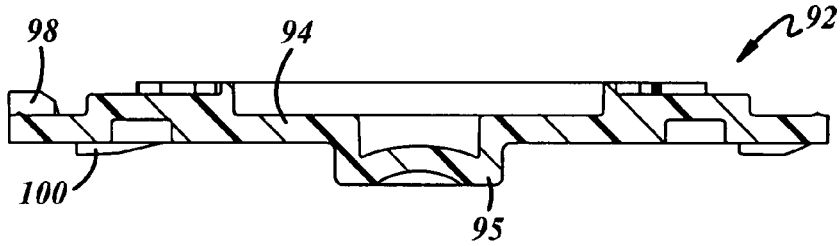
Figure 21:
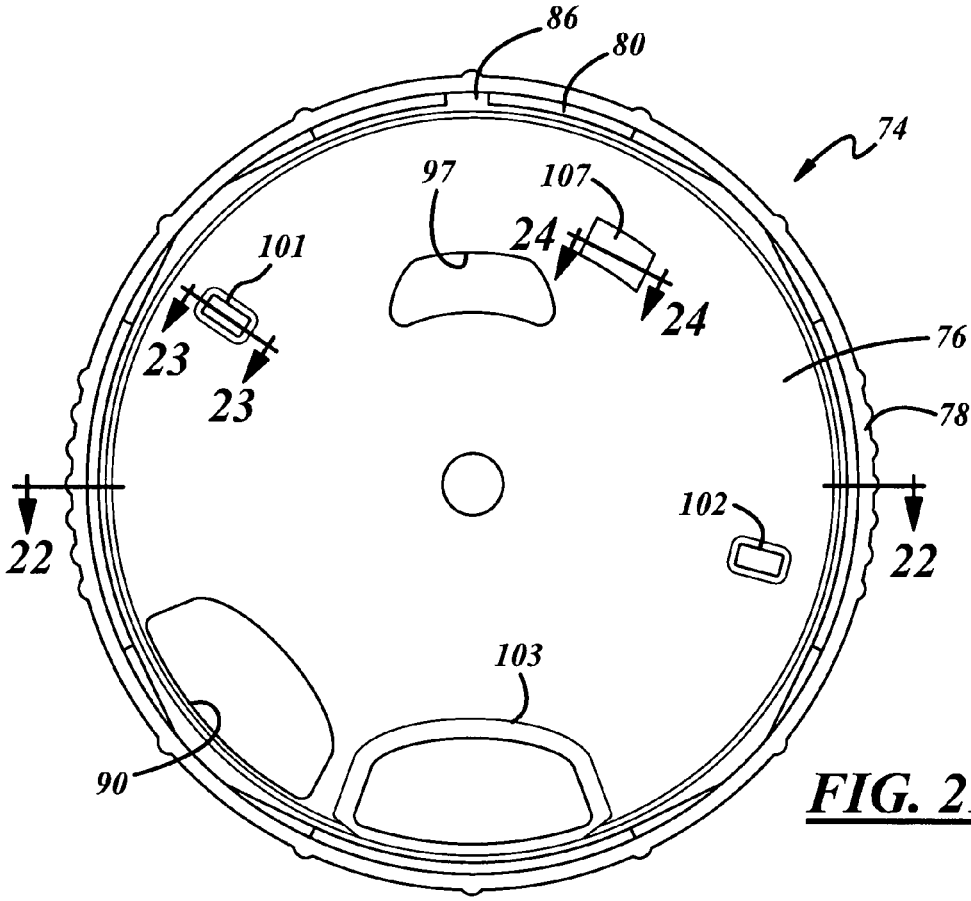
FIG. 21 is a bottom or inside plan view of the closure in the package of FIGS. 1-8.
Figure 22:
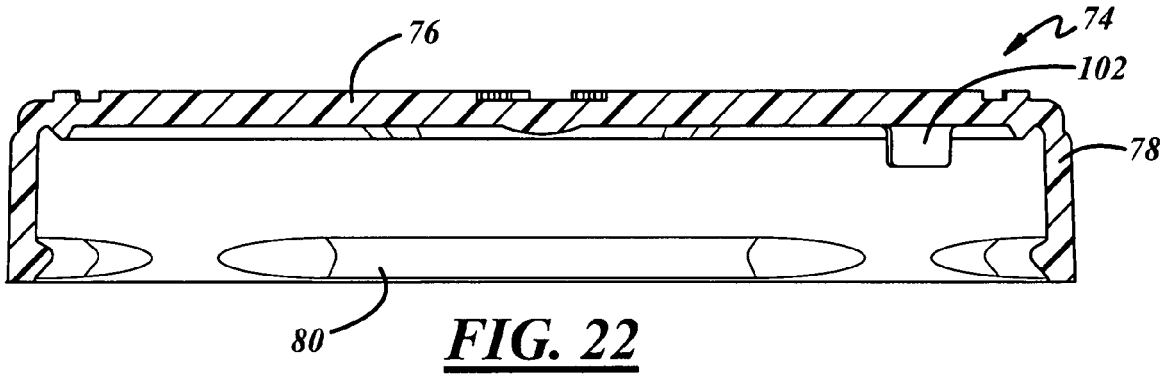
FIGS. 22, 23 and 24 are sectional views taken substantially along the respective lines 22-22, 23-23 and 24-24 in FIG. 21.
Figure 23:
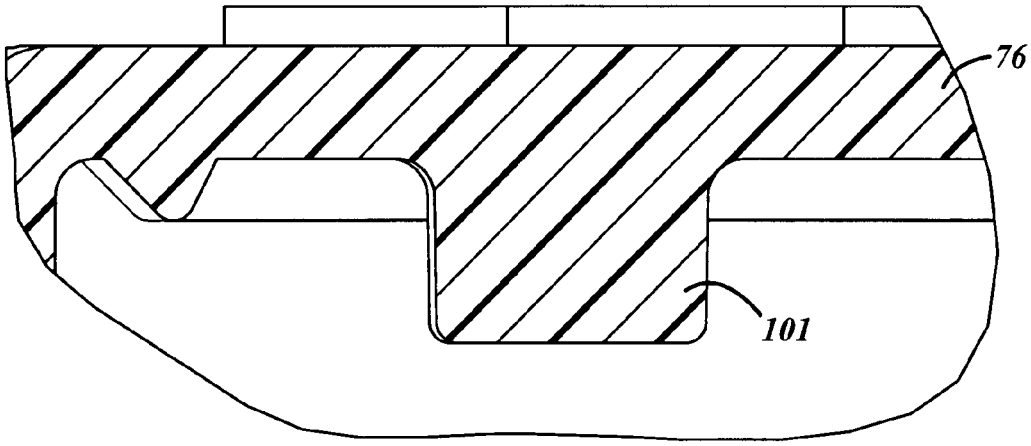
Figure 24:
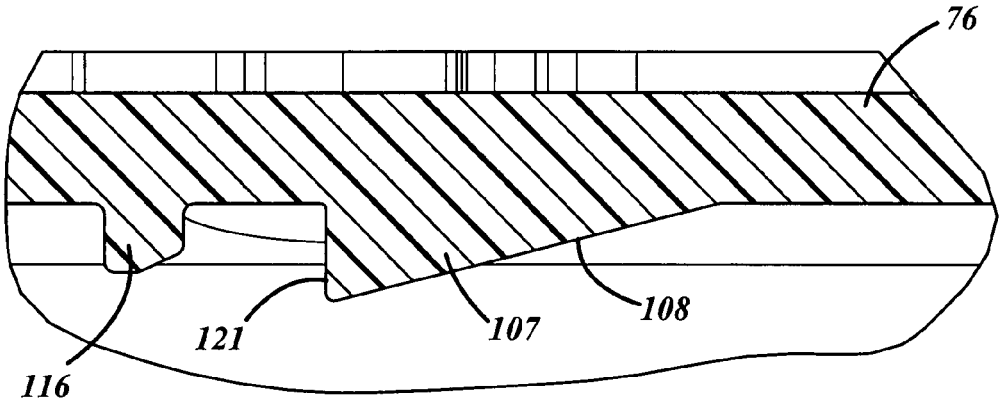

An indexing disk 92 preferably is disposed between closure 74 and neck end wall 60, preferably within neck end wall shoulder 64. Indexing disk 92 includes a main disk body 94 (FIG. 17) having a central post 96 that is rotatably received in assembly within pocket 66 of recessed shoulder 64 (FIG. 3). Dosage time indicia 96 are provided around the periphery of disk body 94 for selective alignment with a dosage window formed by an opening 97 in closure end wall 76. The periphery of disk 92 includes a circumferential series of upstanding raised bumps 98 (FIGS. 7, 8, 17, 18 and 20) alternating with a circumferential series of downwardly angled flexible resilient disk fingers 100. Disk fingers 100 extend circumferentially in the counterclockwise direction as viewed from above (FIG. 17). The disk fingers are angled and disposed to engage one of the disk stops 68 on recessed shoulder 64. Raised bumps 98 are positioned to be engaged by an angled protrusion 107 that extends from the undersurface of closure end wall 76 (FIGS. 8, 21 and 24). Bumps 98 have clockwise facing cam surfaces 104 (as viewed from above in FIGS. 17 and 18) and counterclockwise facing abutment faces 106. Protrusions have counterclockwise facing cam surfaces 108 and clockwise facing abutment faces 121 (FIG. 24). A protrusion 116 (FIG. 24) adjacent to protrusion 107 helps capture disk bump 98 during rotation toward the open position Thus, release of the child resistance mechanism of the package and rotation of closure 74 in the clockwise direction toward alignment of dispensing openings 90,62, angled protrusion 107 on the undersurface of closure end wall 76 engages the abutment face 106 of one of the raised bumps 98 on indexing disk 92. Continued clockwise rotation of closure 74 simultaneously rotates disk 92 on recessed shoulder 64 until dispensing openings 90, 62 are aligned and an item can be dispensed from within housing 32. As this rotation occurs, spring fingers 100 on the periphery of disk 92 engage and resiliently cam over disk stop 68 on recessed shoulder 64. After the product is dispensed, closure 74 can be rotated counterclockwise on neck 58 until the dispensing openings 90,62 are no longer aligned and slot 86 snaps over rib 84, which prevents further counterclockwise rotation of the cap. During this counterclockwise rotation of closure 74, a disk finger 100 will engage disk stop 68 on recessed shoulder 64 and prevent reverse or counterclockwise rotation of indexing disk 92. When closure 74 has been returned to the original non-dispensing position, indicia 96 on disk 92 can be viewed through window opening 97 on closure end wall 76 to indicate a dosage time. This dosage time preferably is when the last dose was taken, but could be when the next dose is to be taken.

Figure 9:
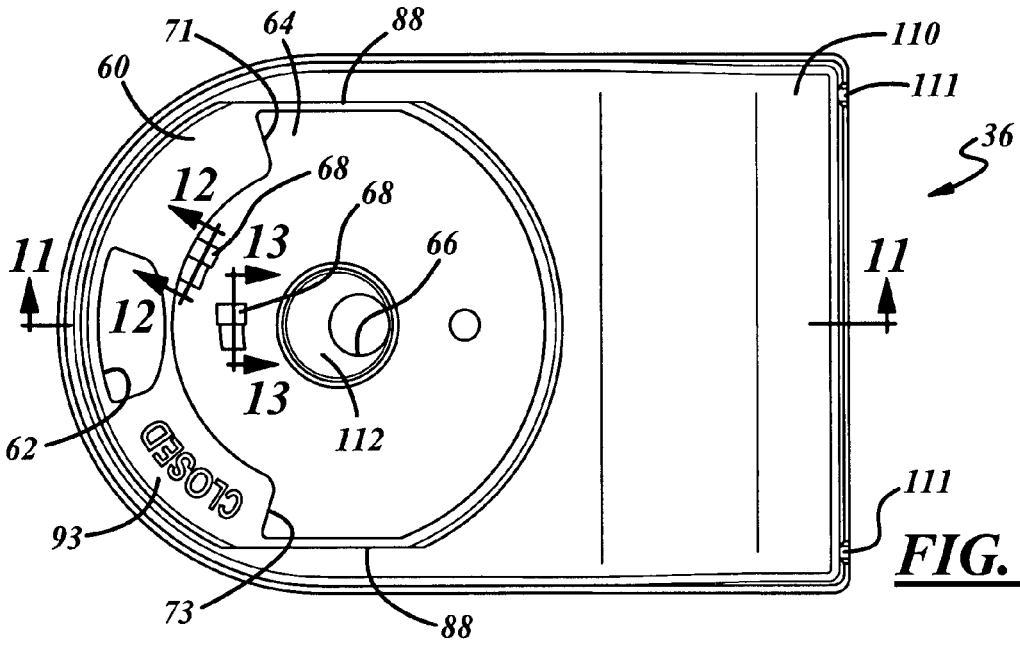
FIG. 9 is a top or outside plan view of the housing top panel in the package of FIGS. 1-8.
Figure 10:
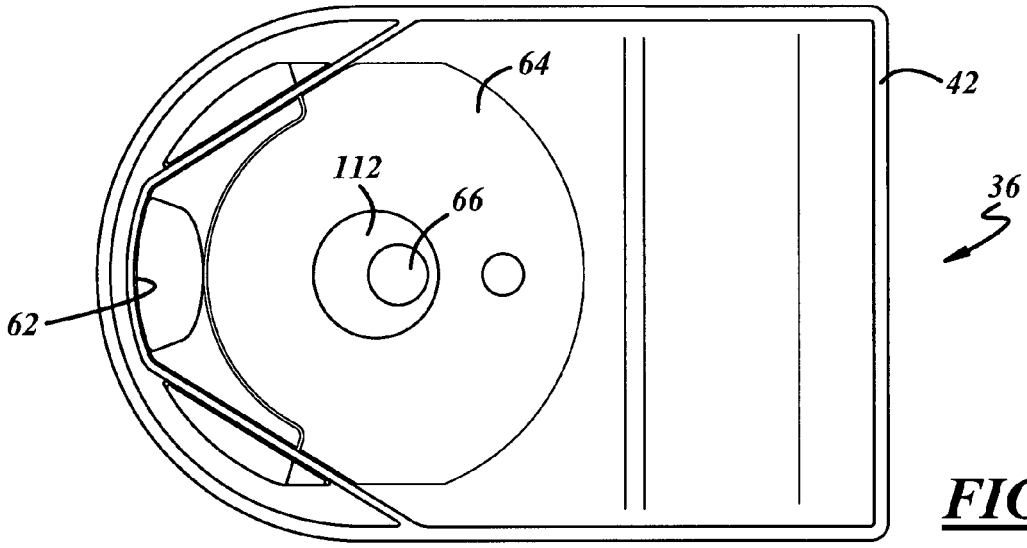
FIG. 10 is a bottom or inside plan view of the housing top panel in FIG. 9.
Figure 11:
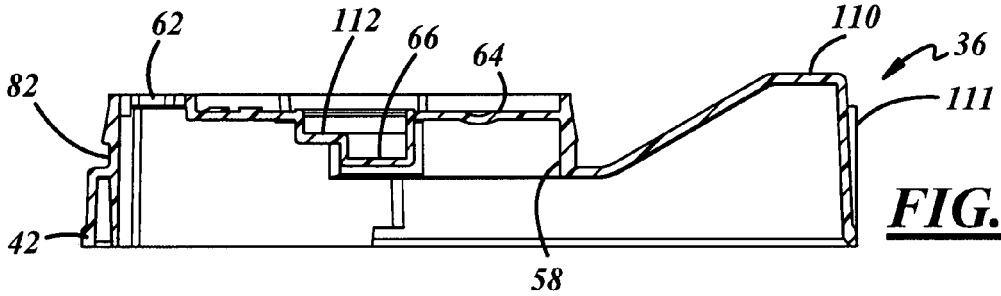
FIGS. 11, 12 and 13 are sectional views taken substantially along the respective lines 11-11, 12-12 and 13-13 in FIG. 9.
Figure 12:
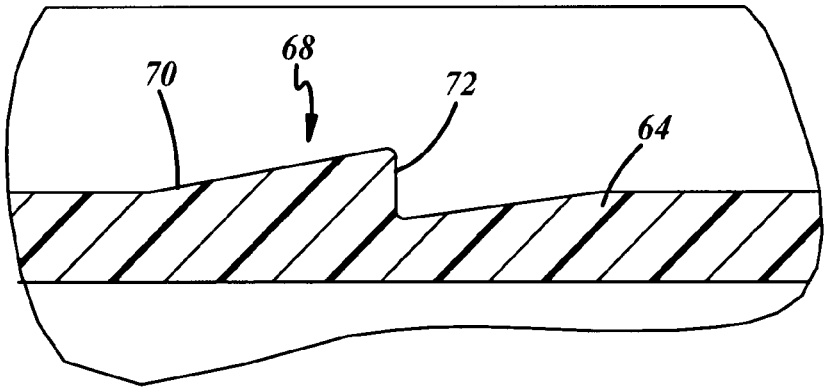
Figure 13:
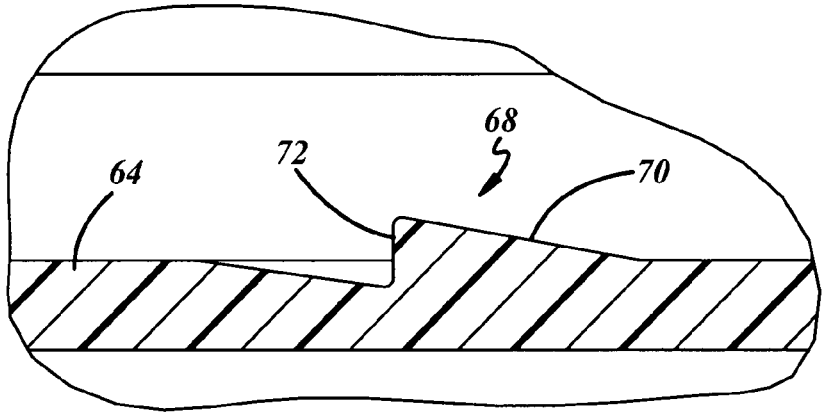

Indicia 93 preferably are provided on neck end wall 60 at a position counterclockwise from dispensing opening 62, as viewed from above in FIG. 9, for alignment with dispensing opening 90 in closure 74 to indicate to a user that the package is CLOSED. Indicia 123 (FIGS. 1-2 and 7) preferably are provided on closure end wall 76 adjacent to window 97 to indicate to a user the significance of the indexing disk indicia viewed through window 97, such as LAST DOSAGE TAKEN. Indicia 91, 93, 96, 123 preferably are molded onto the respective elements (which preferable are all molded plastic construction) but would be printed on the respective elements or provided on labels adhered to the respective elements. Multiple disk stops 68 (FIGS. 7, 9 and 12-13) preferably are provided at differing radii on shoulder 64 of neck end wall 60 to accommodate indexing disks 92 of differing diameter for indicating different dosage periods. For example, a disk 92 of lesser diameter can be used for indicating six dosage times as shown, while a disk 92*a* (phantom in FIG. 3) of greater diameter would be used for indicating different user dosage times such as the days of the week. Pocket 66 preferably has an off-center step 112 (FIGS. 3, 7 and 9) for receiving a post 95*a* (phantom in FIG. 3) of larger disk 92*a*. It will be noted in FIGS. 1-3 that housing top plate 36 preferably has a raised flat wall 110 spaced from neck 58 and at a level to be substantially coplanar with closure end wall 76. This raised wall 110 cooperates with closure end wall 76 to provide a substantially flat surface that is parallel to bottom plat 34 to facilitate standing of the package one upon another. Spaced pads 111 (FIGS. 2-3, 6-7, 9 and 11) preferably are provided on housing 32 to stand package 30 in vertical orientation. End wall 76 of closure 74 preferably has a flat area 114 (FIGS. 1-2 and 7) for placement of a personally coded sticker or other information.

There thus has been disclosed a child-resistant package that fully satisfies all of the objects and aims previously set forth. The disclosure has been presented in conjunction with an exemplary embodiment, and a number of modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A child-resistant package that includes:

a housing having an internal volume for holding items to be dispensed, a cylindrical neck, an end wall on said neck and a dispensing opening in said end wall, a closure having an end wall, a skirt and a dispensing opening in said end wall, one of said skirt and said neck including a channel and the other of said skirt and said neck having a bead for receipt in said channel such that said closure is rotatable on said neck for selectively aligning said dispensing openings to dispense items from within said housing, and a child resistance mechanism between said closure and said neck to resist rotation of said closure on said neck, wherein said end wall of said closure includes a dosage window, and wherein said package includes a disk disposed between said closure and said end wall of said neck having dosage indicia viewable through said dosage window and a ratchet drive among said closure, said disk and said housing for indexing said disk upon each rotation of said closure on said neck to align said dispensing openings.

2. The package set forth in claim 1 wherein said skirt is flexible and resilient, and wherein said child resistance mechanism is a squeeze-and-turn mechanism that includes a rib in said channel and a slot in said bead for snap receipt over said rib to prevent rotation of said closure on said neck absent ovalization of said skirt.

3. The child-resistant package of claim 1 wherein said dispensing openings are disposed radially outboard of said disk.

4. A child-resistant package that includes:

a housing having an internal volume for holding items to be dispensed, a cylindrical neck, an end wall on said neck, a dispensing opening in said end wall, an external channel extending around said neck and a rib in said channel, a closure having an end wall with a dispensing opening, a flexible resilient skirt, an internal bead on said skirt slidably received in said channel to guide rotation of said closure on said neck, a slot in said bead for snap receipt over said rib to prevent rotation of said closure on said neck absent ovalization of said skirt, and a dosage window in said end wall of said closure, and a disk disposed between said closure and said end wall of said neck having dosage indicia viewable through said dosage window and a ratchet drive among said closure, said disk and said housing for indexing said disk upon each rotation of said closure on said neck to align said dispensing openings.

5. The package set forth in claim 4 wherein said neck has diametrically opposed flats that interrupt said channel and permit inward flexure of said closure skirt into said flats.

6. The package set forth in claim 5 wherein said ratchet drive includes a protrusion on an undersurface of said closure end wall and an array of raised bumps on said disk, said protrusion engaging one of said bumps to rotate said disk as said closure is rotated to align said dispensing openings.

7. The package set forth in claim 6 wherein said ratchet drive further includes a disk stop on said end wall of said neck and a series of flexible resilient fingers on said disk to engage said stop and prevent reverse rotation of said disk.

8. The package as set forth in claim 4 wherein said closure and said housing have a first pair of stops to rotation of said closure in one direction on said housing when said dispensing openings are aligned, and a second pair of stops to stop rotation of said closure in a second direction on said housing in which said dosage window aligns with said dosage indicia on said disk.

9. The package set forth in claim 8 wherein said housing has indicia viewable through said dispensing opening of said closure to confirm that the package is closed.

10. A child-resistant package that includes:

a housing having an internal volume for holding items to be dispensed, a cylindrical neck, an end wall on said neck and a dispensing opening in said end wall, a closure having an end wall, a flexible resilient skirt and a dispensing opening in said end wall, one of said skirt and said neck including a channel and the other of said skirt and said neck having a bead for receipt in said channel such that said closure is rotatable on said neck for selectively aligning said dispensing openings to dispense items from within said housing, and a child resistance mechanism between said closure and said neck to resist rotation of said closure on said neck, said child resistance mechanism being a squeeze-and-turn mechanism that includes a rib in said channel and a slot in said bead for snap receipt over said rib to prevent rotation of said closure on said neck absent ovalization of said skirt.

11. The package set forth in claim 10 wherein said neck has diametrically opposed flats to permit inward flexure of said closure skirt into said flats.

12. The package set forth in claim 11 wherein said channel is an external channel on said neck which is interrupted by said flats, and wherein said bead is an internal bead on said closure skirt.

13. The package set forth in claim 10 said end wall of said closure includes a dosage window, and wherein said package includes a disk disposed between said closure and said end wall of said neck having dosage indicia viewable through said dosage window and a ratchet drive among said closure, said disk and said housing for indexing said disk upon each rotation of said closure on said neck to align said dispensing openings.

14. A child-resistant package that includes:

a housing having an internal volume for holding items to be dispensed, a cylindrical neck, an end wall on said neck and a dispensing opening in said end wall, a closure having an end wall, a skirt and a dispensing opening in said end wall, one of said skirt and said neck including a channel and the other of said skirt and said neck having a bead for receipt in said channel such that said closure is rotatable on said neck for selectively aligning said dispensing openings to dispense items from within said housing, and a child resistance mechanism between said closure and said neck to resist rotation of said closure on said neck, wherein said end wall of said closure includes a dosage window, and wherein said package includes a disk disposed between said closure and said end wall of said neck having dosage indicia viewable through said dosage window and a ratchet drive among said closure, said disk and said housing for indexing said disk upon each rotation of said closure on said neck to align said dispensing openings, and including a post extending from said disk and rotatably received in a pocket in said end wall of said neck.

15. The package set forth in claim 14 wherein said pocket has an off-center step for receiving posts on disks of differing diameter.

16. The package set forth in claim 14 wherein said ratchet drive includes a protrusion on an undersurface of said closure end wall and an array of raised bumps on said disk, said protrusion engaging one of said bumps to rotate said disk as said closure is rotated to align said dispensing openings.

17. The package set forth in claim 16 wherein said ratchet drive further includes a disk stop on said end wall of said neck and a series of flexible resilient fingers on said disk to engage said disk stop and prevent reverse rotation of said disk.

18. The package set forth in claim 14 wherein said disk is disposed on a shoulder in said end wall of said neck.

19. The package set forth in claim 14 wherein said closure and said housing have a first pair of stops to stop rotation of said closure in one direction on said housing when said dispensing openings are aligned, and a second pair stops to stop rotation of said closure in a second direction on said housing who said dosage window aligns with said dosage indicia on said disk.

20. The package set forth in claim 19 wherein said housing has indicia viewable through said dispensing opening of said closure to confirm that the package is closed.

21. A child-resistant package that includes:

a housing having an internal volume for holding items to be dispensed, a cylindrical neck, an end wall on said neck, a dispensing opening in said end wall, an external channel extending around said neck and a rib in said channel, a closure having an end wall with a dispensing opening, a flexible resilient skirt, an internal rib on said skirt slidably received in said channel to guide rotation of said closure on said neck, a slot in said bead for snap receipt over said rib to prevent rotation of said closure on said neck absent ovalization of said skirt, and a dosage window in said end wall of said closure, and a disk disposed between said closure and said end wall of said neck having dosage indicia viewable through said dosage window and a ratchet drive among said closure, said disk and said housing for indexing said disk upon each rotation of said closure on said neck to align said dispensing openings, wherein said disk is disposed on a shoulder in said end wall of said neck and said disk includes a post rotatably received in a pocket on said shoulder.

22. The package set forth in claim 21 wherein said pocket has an off-center step for receiving posts on disks of differing diameter.

23. A child-resistant package that includes:

a housing having an internal volume for holding items to be dispensed, a cylindrical neck, an end wall on said neck and a dispensing opening in said end wall, a closure having an end wall, a skirt and a dispensing opening in said end wall, one of said skirt and said neck including a channel and the other of said skirt and said neck having a bead for receipt in said channel such that said closure is rotatable on said neck for selectively aligning said dispensing openings to dispense items from within said housing, and a child resistance mechanism between said closure and said neck to resist rotation of said closure on said neck, wherein said end wall of said closure includes a dosage window, and wherein said package includes a disk disposed between said closure and said end wall of said neck having dosage indicia viewable through said dosage window and a ratchet drive among said closure, said disk and said housing for indexing said disk upon each rotation of said closure on said neck to align said dispensing openings, wherein said housing includes a top panel, including said neck, welded to a bottom plate.

24. A child-resistant package that includes:

a housing having an internal volume for holding items to be dispensed, a cylindrical neck, an end wall on said neck and a dispensing opening in said end wall, a closure having an end wall, a skirt and a dispensing opening in said end wall, one of said skirt and said neck including a channel and the other of said skirt and said neck having a bead for receipt in said channel such that said closure is rotatable on said neck for selectively aligning said dispensing openings to dispense items from within said housing, and a child resistance mechanism between said closure and said neck to resist rotation of said closure on said neck, wherein said end wall of said closure includes a dosage window, and wherein said package includes a disk disposed between said closure and said end wall of said neck having dosage indicia viewable through said dosage window and a ratchet drive among said closure, said disk and said housing for indexing said disk upon each rotation of said closure on said neck to align said dispensing openings, wherein said housing has a flat wall opposite said neck, a fill opening in said flat wall and a cap in said fill opening, said cap having a wall that is flush with said flat wall forming a label application area over said cap on said flat wall.

25. The package set forth in claim 24 wherein said housing has an enlarged portion spaced from said neck, said enlarged portion having a surface that cooperates with said end wall of said closure to form a flat surface parallel to said flat wall for stacking said packages one upon another.

26. A child-resistant package that includes:

a housing having an internal volume for holding items to be dispensed, a cylindrical neck, an end wall on said neck, a dispensing opening in said end wall, an external channel extending around said neck and a rib in said channel, a closure having an end wall with a dispensing opening, a flexible resilient skirt, an internal rib on said skirt slidably received in said channel to guide rotation of said closure on said neck, a slot in said bead for snap receipt over said rib to prevent rotation of said closure on said neck absent ovalization of said skirt, and a dosage window in said end wall of said closure, and a disk disposed between said closure and said end wall of said neck having dosage indicia viewable through said dosage window and a ratchet drive among said closure, said disk and said housing for indexing said disk upon each rotation of said closure on said neck to align said dispensing openings, wherein said housing includes a top panel, including said neck, welded to a bottom plate.

27. A child-resistant package that includes:

a housing having an internal volume for holding items to be dispensed, a cylindrical neck, an end wall on said neck, a dispensing opening in said end wall, an external channel extending around said neck and a rib in said channel, a closure having an end wall with a dispensing opening, a flexible resilient skirt, an internal rib on said skirt slidably received in said channel to guide rotation of said closure on said neck, a slot in said bead for snap receipt over said rib to prevent rotation of said closure on said neck absent ovalization of said skirt, and a dosage window in said end wall of said closure, and a disk disposed between said closure and said end wall of said neck having dosage indicia viewable through said dosage window and a ratchet drive among said closure, said disk and said housing for indexing said disk upon each rotation of said closure on said neck to align said dispensing openings, wherein said housing has a flat wall opposite said neck, a fill opening in said flat wall and a cap in said fill opening, said cap having a wall that is flush with said flat wall forming a label application area over said cap on said flat wall.

28. The package set forth in claim 27 wherein said housing has an enlarged portion spaced from said neck, said enlarged portion having a surface that cooperates with said end wall of said closure to form a flat surface parallel to said flat wall for stacking said packages one upon another.

* * * * *